US008122629B2

(12) United States Patent
Cowgill

(10) Patent No.: US 8,122,629 B2
(45) Date of Patent: Feb. 28, 2012

(54) COLLAPSIBLE SIGN

(76) Inventor: John Cowgill, Lincoln City, OR (US)

( * ) Notice: Subject to any disclaimer, the term of this patent is extended or adjusted under 35 U.S.C. 154(b) by 527 days.

(21) Appl. No.: 12/324,616

(22) Filed: Nov. 26, 2008

(65) Prior Publication Data

US 2009/0139124 A1 Jun. 4, 2009

Related U.S. Application Data

(63) Continuation-in-part of application No. 29/298,224, filed on Nov. 30, 2007, now Pat. No. Des. 584,362.

(51) Int. Cl.
*G09F 15/00* (2006.01)

(52) U.S. Cl. ..... 40/610; 40/612; 248/170; 248/166

(58) Field of Classification Search ..... 40/610, 40/607.09, 607.1, 606.16, 606.17, 612; 248/136, 248/150, 170, 165, 166, 188.7; 116/173–175; 403/108, 109.3, 109.7
See application file for complete search history.

(56) References Cited

U.S. PATENT DOCUMENTS

| | | | | | |
|---|---|---|---|---|---|
| 351,990 | A | | 11/1886 | Mansure | |
| 643,945 | A | * | 2/1900 | Clifford | 116/173 |
| 695,663 | A | * | 3/1902 | Weirich | 116/173 |
| 2,447,075 | A | * | 8/1948 | Madsen | 116/173 |
| 2,793,453 | A | | 5/1957 | Bixby | |
| 2,921,763 | A | * | 1/1960 | Miller et al. | 248/121 |
| 3,483,999 | A | | 12/1969 | Barrett | |
| 3,850,401 | A | * | 11/1974 | Snediker | 248/292.13 |
| 4,103,445 | A | | 8/1978 | Smith et al. | |
| 4,375,134 | A | | 3/1983 | Sheetz | |
| 4,685,233 | A | | 8/1987 | Hull | |
| 4,700,655 | A | | 10/1987 | Kirby | |
| 4,817,319 | A | | 4/1989 | Vitale | |
| 4,905,391 | A | | 3/1990 | Dillon | |
| D362,465 | S | * | 9/1995 | Gallemore, II | D20/41 |
| 5,533,464 | A | * | 7/1996 | Todd | 116/174 |
| 5,551,177 | A | | 9/1996 | Cowgill et al. | |
| 5,551,178 | A | | 9/1996 | Foley et al. | |
| 5,598,654 | A | | 2/1997 | Cowgill et al. | |
| 5,694,711 | A | | 12/1997 | Cowgill et al. | |
| 5,729,926 | A | | 3/1998 | Cowgill et al. | |
| 5,829,178 | A | * | 11/1998 | Hillstrom | 40/610 |
| 6,038,802 | A | | 3/2000 | Tidwell | |
| 6,761,357 | B2 | | 7/2004 | Witt et al. | |
| 6,923,141 | B1 | | 8/2005 | Staats et al. | |
| 7,318,266 | B2 | * | 1/2008 | Bergh | 29/434 |
| 7,530,543 | B1 | * | 5/2009 | Kremzar | 248/441.1 |

* cited by examiner

*Primary Examiner* — Casandra Davis
(74) *Attorney, Agent, or Firm* — Marger Johnson & McCollom, P.C.

(57) ABSTRACT

A collapsible sign comprising a pivotal sign carrying member, an upright member hingedly attached to the pivotal sign carrying member, and a foldable support member adapted to stabilize the upright member and the pivotal sign carrying member. The pivotal sign carrying member may be adapted to lock into a substantially perpendicular arrangement with the upright member, or fold into a substantially parallel arrangement with the upright member. A flexible membrane may be rolled around the pivotal sign carrying member. Further, the collapsible sign may include a foldable support having an asymmetric arrangement of legs attached to the upright member. Alternatively, the collapsible sign may include a support member comprising a base member in a perpendicular arrangement with the upright member, and including penetration means for stabilizing the upright member and the sign carrying member.

15 Claims, 15 Drawing Sheets

COLLAPSIBLE SIGN

RELATED APPLICATION DATA

This application is a continuation-in-part of U.S. patent application Ser. No. 29/298,224, entitled C-FRAME SIGN, filed Nov. 30, 2007, now U.S. D584,362 S, issued Jan. 6, 2009, which is hereby incorporated by reference.

FIELD OF THE INVENTION

This application pertains to a sign, and more particularly, to a collapsible sign having a pivotal sign carrying member, an upright member, and a foldable support member.

BACKGROUND OF THE INVENTION

Signs are used to convey information. For example, in the real estate industry, information about pending home sales, open houses, and the like, must be effectively conveyed to potential home buyers or other interested individuals. Other industries such as furniture outlet stores, mattress stores, automobile shops—among many others—use temporary signage to promote special discounts or ongoing promotional offers. Once a home has sold (or the special discount or promotional offer has ended) the signs used to convey the information may be taken down, transported to another location, or simply stored for later use. There are numerous other examples where temporary signs can enhance an ability to convey information; for example, consider home based business parties, tasting parties, small business advertising, among other possibilities—these and other diverse industries are in need of improved temporary signage.

Transporting a sign can be a problem. For example, signs used in the real estate industry are generally bulky and difficult to fit into a vehicle, let alone a trunk or other storage compartment. Quite often more than one sign must be arranged within one vehicle, sometimes dozens of signs at a time, because real estate professionals often like to place multiple signs at various locations around a neighborhood to create a virtual detour to direct traffic toward an open house (i.e., toward a home for sale). Moreover, real estate agents or other real estate sales professionals generally avoid driving large vehicles, such as pick-up trucks or sport utility vehicles; instead, they are more likely to drive client-friendly vehicles such as a luxury sedan or compact car, which are more conducive to frequent travel between homes or other locations, and are generally less expensive to fuel and maintain than larger vehicles. Thus, the real estate agents or other real estate sales professionals are left to their own particular struggles of trying to fit bulky real estate signs into a smaller-type vehicle, generally into a trunk of the vehicle.

Time is a precious commodity. The time taken to disassemble or assemble a sign is time that could be spent elsewhere, perhaps more productively. This is particularly true for a general manager of a store, for example, who may want to convey important information to prospective customers for a temporary period of time, perhaps by placing a sign on a sidewalk in front of the store, but may not want to spend an inordinate amount of time to assemble and disassemble the sign between each temporary period of time. For example, the general manager may have a special promotional offer once every month for one week out of the month. For the one week out of the month having the special promotional offer, the general manager would need to locate, assemble, and place the sign in the desired path of the prospective customers, and then disassemble and store the sign after the special promotional offer has ended. Even more burdensome, the general manager may choose to have the special promotional offer for one hour out of every day, for example. In that case, the sign would need to be assembled, placed, and disassembled every day.

This is not much different than the real estate industry where real estate agents or other professionals are constantly relocating signs as a result of placing homes on the market for sale, and removing homes from the market because they have either sold or because the owner has given up trying to make the sale. As another example, the real estate agent may want to put an open house sign in front of a home each Sunday (or some other day of the week) when people are more likely to want to browse the interior of the home, and then take the sign down when the open house has ended, transport the sign to a new location, and repeat the routine.

Conventional signs are often not very versatile, nor are they generally able to withstand the elements. For example, a gusty wind can cause a sign to tip over, spin around, or twist so that a potential onlooker fails to see the writing or drawings on the sign. This can lead to lost sales, decreased revenues, and even worse—layoffs or a complete closure of a business.

Accordingly, a need remains for an improved sign for conveying information; in particular, a need remains for an improved collapsible sign that is easily transportable and can withstand the elements.

SUMMARY OF THE INVENTION

An example embodiment of the present invention may comprise a pivotal sign carrying member, an upright member hingedly attached to the pivotal sign carrying member, and a foldable support member adapted to stabilize the upright member and the pivotal sign carrying member.

The foregoing and other features, objects, and advantages of the invention will become more readily apparent from the following detailed description, which proceeds with reference to the accompanying drawings.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

DETAILED DESCRIPTION

Figure 1:
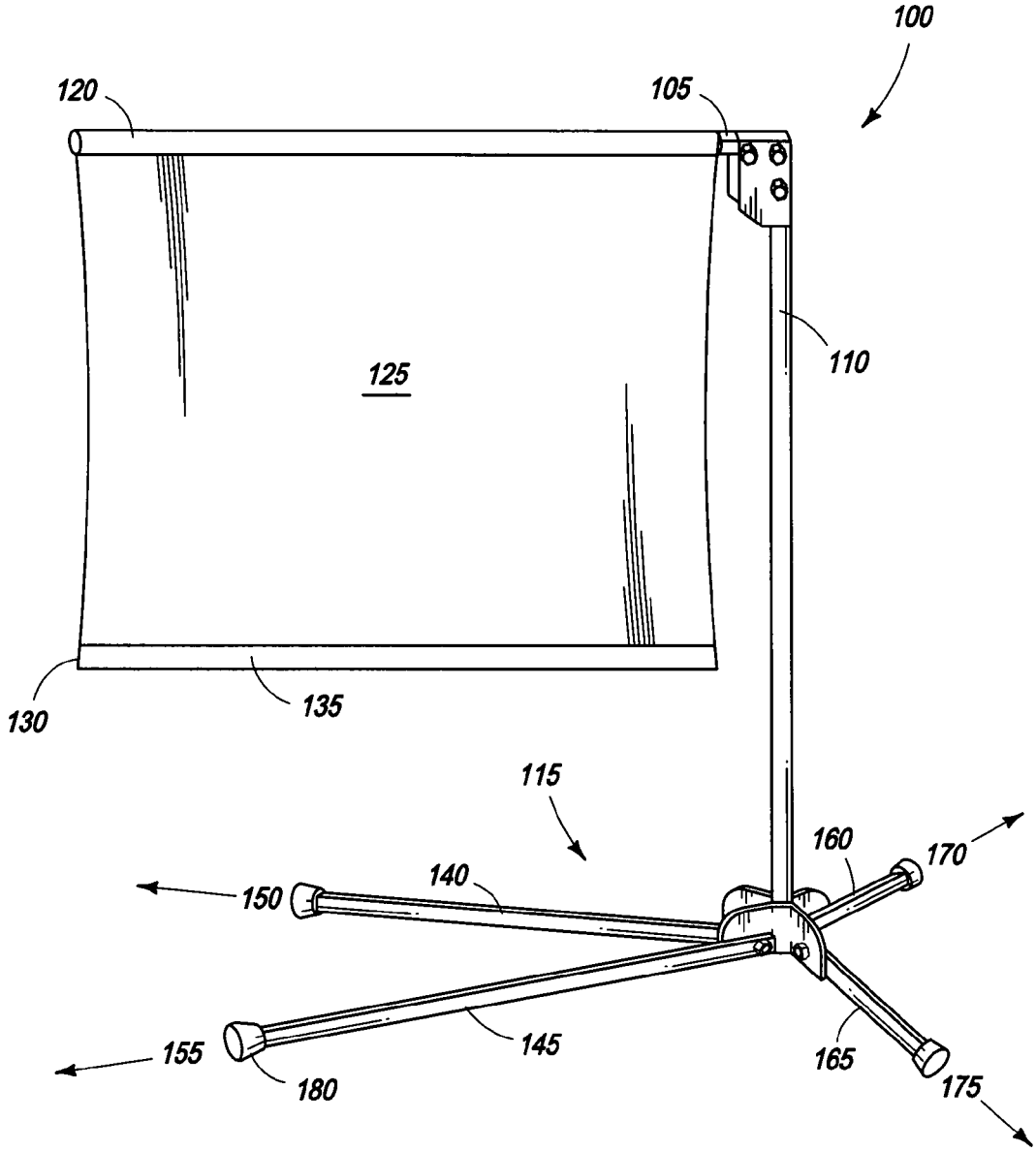
FIG. 1 illustrates a collapsible sign including a pivotal sign carrying member, an upright member, and a foldable support member, according to an example embodiment of the present invention.

FIG. 1 illustrates a collapsible sign 100 including a pivotal sign carrying member 105, an upright member 110, and a foldable support member 115, according to an example embodiment of the present invention. The pivotal sign carrying member 105, the upright member 110, the foldable support member 115, or other parts of the sign 100, may comprise metal, fiberglass, wood, or other suitable materials. The sign 100 may comprise flexible materials to enhance the overall stability of the sign 100, or relatively non-flexible materials to enhance the overall strength and support of the sign 100. The upright member 110 may be hingedly attached to the pivotal sign carrying member 105. The pivotal sign carrying member 105 may be adapted to lock into a substantially perpendicular arrangement with the upright member 110, and may also be adapted to fold into a substantially parallel arrangement with the upright member 110 as later described.

The sign 100 may further include a first sleeve 120 adapted to fit over the pivotal sign carrying member 105 and a flexible membrane 125. The flexible membrane 125 may comprise a sign blank such as a canvas, cloth, or paper, among other possible materials, and may also include writing or drawings to convey information to a passerby. One end of the flexible membrane 105 may be coupled to the first sleeve 120. Another end of the flexible membrane 105 may be coupled to a second sleeve 135. The second sleeve 135 may be adapted to fit over a weighted bottom 130. The first sleeve 120 may be attached to the pivotal sign carrying member 105 and the second sleeve 135 may be attached to the weighted bottom 130.

While the weighted bottom 130 and the second sleeve 135 may or may not be included as part of the collapsible sign 100, they are preferably included because gravity pulls the flexible membrane 105 taut so that any writing or drawings are readily visible. Moreover, the flexible membrane 105 may more easily be rolled around the pivotal sign carrying member 105, as later described.

The collapsible sign 100 may also include a foldable support member 115 to stabilize the upright member 110 and the pivotal sign carrying member 105. In one example embodiment, the foldable support member 115 includes an asymmetric arrangement of legs 140, 145, 160, and 165 hingedly attached to the upright member 110. The asymmetric arrangement of legs may include a first leg 140 extending by a first length in a first direction 150; a second leg 145 extending by the first length in a second direction 155; a third leg 160 extending by a second length in a third direction 170; and a fourth leg 165 extending by the second length in a fourth direction 175. The second length may be less than the first length. Alternatively, the second length may be greater than the first length. The asymmetric arrangement of legs stabilizes the sign 100 and also reduces a footprint of the sign, thereby providing a space-saving feature. Although optional, each of the legs 140, 145, 160, and 165 may include an end cap 180, which may comprise rubber, for preventing skidding of the sign 100 on the ground or other surface.

Figure 2:
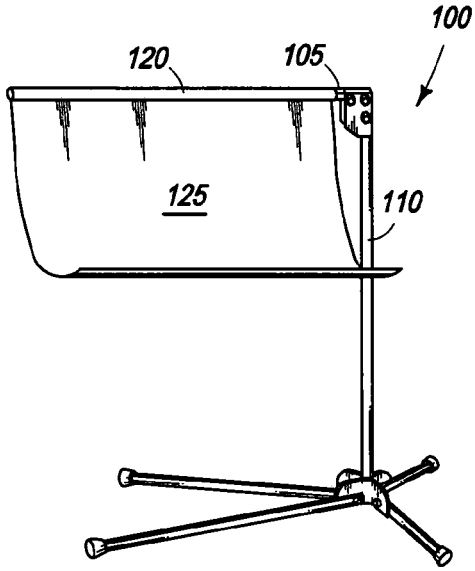
FIGS. 2-5 illustrate the collapsible sign of FIG. 1 in various stages of collapse, including rolling of a flexible membrane around the pivotal sign carrying member and folding the pivotal sign carrying member toward the upright member, according to another example embodiment of the present invention.
Figure 3:
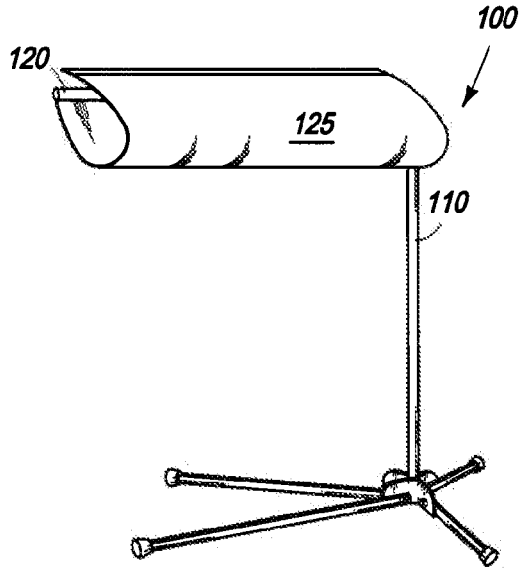
Figure 4:
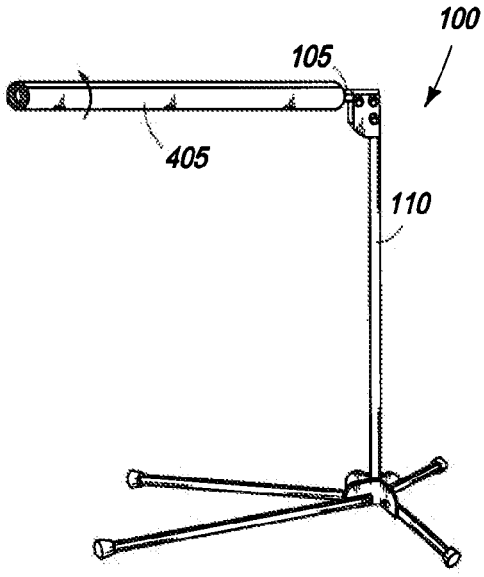
Figure 5:
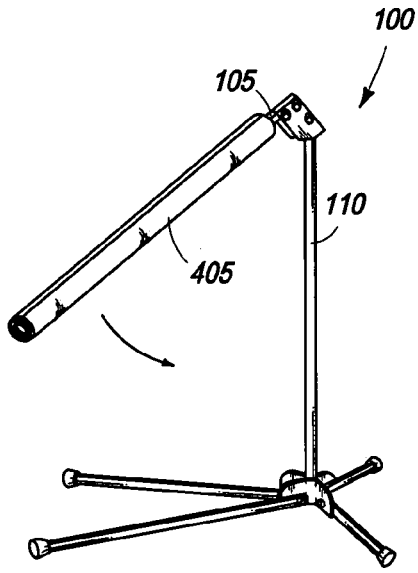

FIGS. 2-5 illustrate the collapsible sign 100 of FIG. 1 in various stages of partial collapse, including rolling of the flexible membrane 125 around the pivotal sign carrying member 105 and folding the pivotal sign carrying member 105 toward the upright member 110, according to another example embodiment of the present invention. Referring to FIGS. 2 and 3, the flexible membrane 125 may be adapted to roll around the pivotal sign carrying member 105. Eventually, the flexible membrane 125 may be rolled around the pivotal sign carrying member 105 to form a substantially cylindrical roll 405, as shown in FIG. 4. After the cylindrical roll 405 is formed, the pivotal sign carrying member 105 and the cylindrical roll 405 may be folded toward the upright member 110, as shown in FIG. 5.

Figure 6:
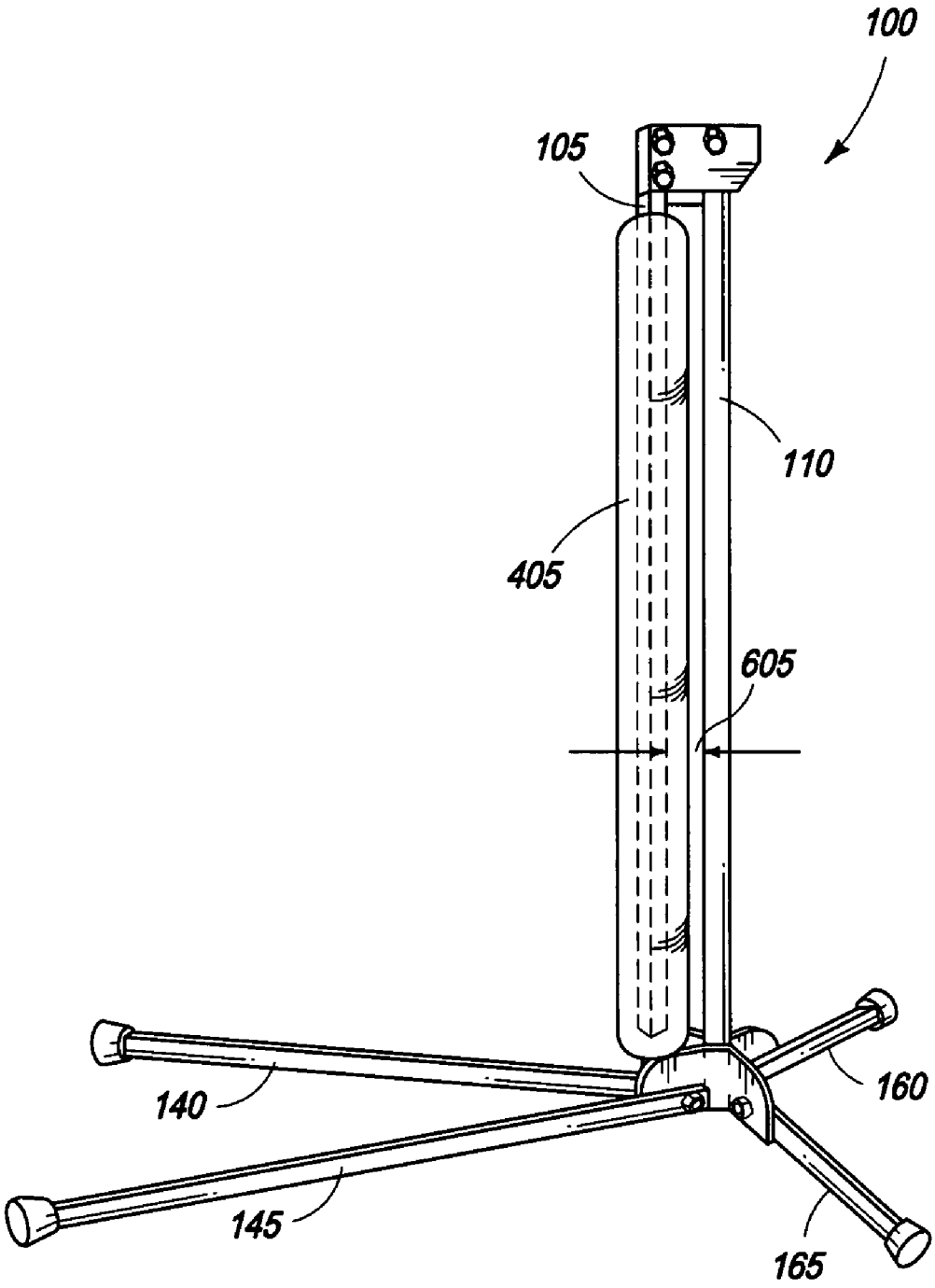
FIG. 6 illustrates a partially collapsed sign, including the pivotal sign carrying member folded into a substantially parallel arrangement with the upright member.

FIG. 6 illustrates a partially collapsed sign 100, including the pivotal sign carrying member 105 folded into a substantially parallel arrangement with the upright member 110. The sign 100 may be structured to comprise a spacing 605 between the pivotal sign carrying member 105 and the upright member 110 to accommodate the cylindrical sign roll 405 when the sign carrying member 105 is folded. In other words, a predefined spacing 605 between the pivotal sign carrying member 105 and the upright member 110 allows the cylindrical sign roll 405 to be folded into the substantially parallel arrangement with the upright member 110 without stressing or damaging the pivotal sign carrying member 105, the upright member 110, or other components of the sign 100.

Figure 7:
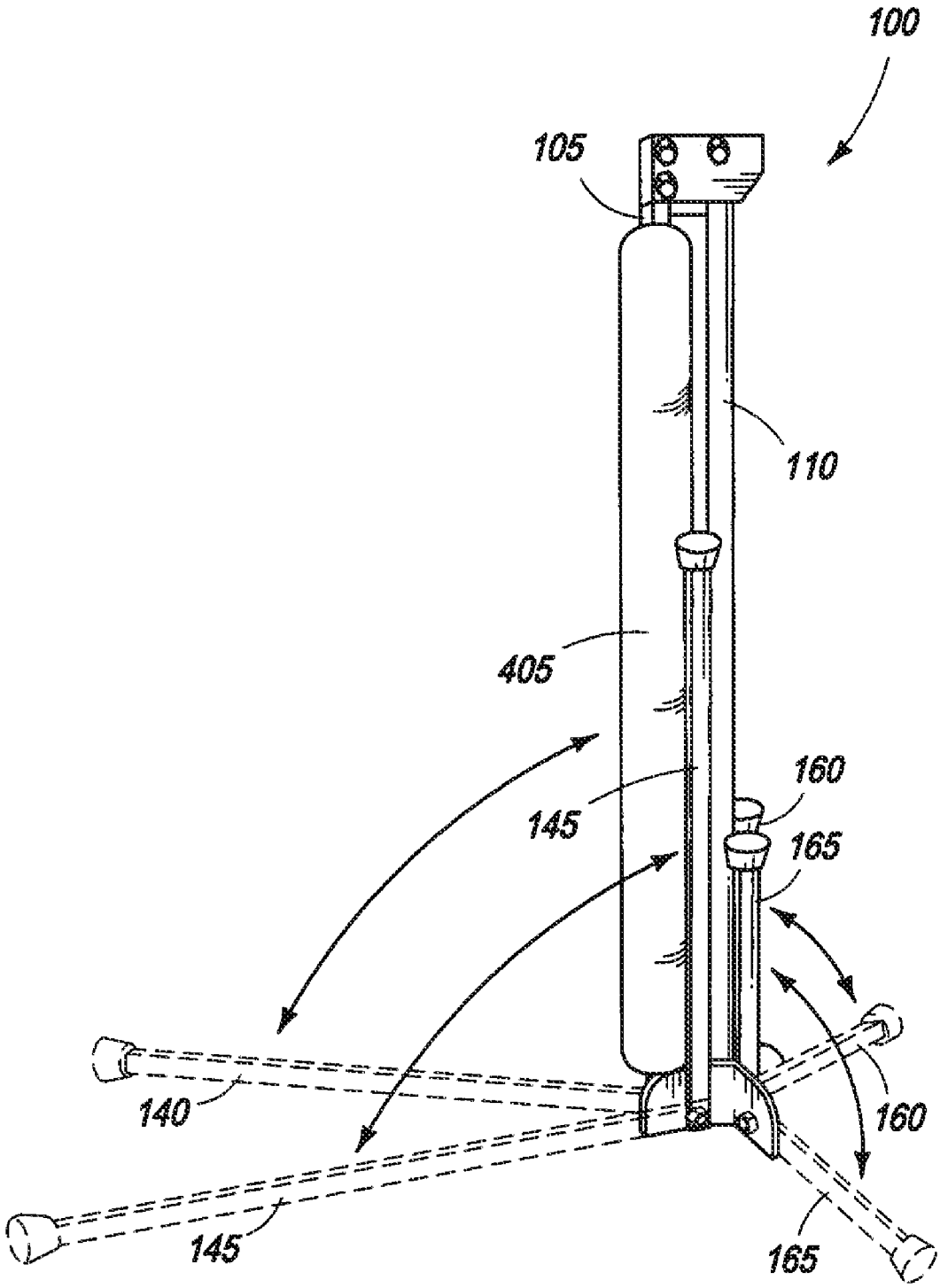
FIG. 7 illustrates the partially collapsed sign of FIG. 6, further including legs folded to a substantially parallel arrangement with the upright member, according to yet another example embodiment of the present invention.

FIG. 7 illustrates the partially collapsed sign 100 of FIG. 6, further including legs 140, 145, 160, and 165 folded to a substantially parallel arrangement with the upright member 110, according to yet another example embodiment of the present invention. Each of the legs 140, 145, 160, and 165 may be folded and unfolded either individually or at a same time. For example, one method for collapsing the sign 100 may include simultaneously folding legs 140, 145, 160, and 165 to a substantially parallel arrangement with the upright member 110. Similarly, one method for un-collapsing the sign 100 may include simultaneously unfolding legs 140, 145, 160, and 165 to locked locations extending in directions outward from the upright member 110.

Pertaining to folding the legs, a first leg 140 may be folded from a location extending in a first direction (e.g., direction 150 of FIG. 1) outward from the upright member 110 to a first location substantially parallel with the upright member 110 of the sign 100. A second leg 145 may be folded from a location extending in a second direction (e.g., direction 155 of FIG. 1) outward from the upright member 110 to a second location substantially parallel with the upright member 110 of the sign 100. A third leg 160 may be folded from a location extending in a third direction (e.g., direction 170 of FIG. 1) outward from the upright member 110 to a third location substantially parallel with the upright member 110 of the sign 100. And a fourth leg 165 may be folded from a location extending in a fourth direction (e.g., direction 175 of FIG. 1) outward from the upright member 110 to a fourth location substantially parallel with the upright member 110 of the sign 100. The legs may be folded sequentially or simultaneously. In addition, the locations from which the legs are folded may include locked locations, as further described below.

Pertaining to unfolding the legs, a first leg 140 may be unfolded from a first location substantially parallel with the upright member 110 of the sign 100 to a locked location extending in a first direction (e.g., direction 150 of FIG. 1) outward from the upright member 110. A second leg 145 may be unfolded from a second location substantially parallel with the upright member 110 of the sign 100 to a locked location extending in a second direction (e.g., direction 155 of FIG. 1) outward from the upright member 110. A third leg 160 may be unfolded from a third location substantially parallel with the upright member 110 of the sign 100 to a locked location extending in a third direction (e.g., direction 170 of FIG. 1) outward from the upright member 110. And a fourth leg 165 may be unfolded from a fourth location substantially parallel with the upright member 110 of the sign 100 to a locked location extending in a fourth direction (e.g., direction 175 of FIG. 1) outward from the upright member 110. Similar to the folding of the legs above as described above, the legs may be unfolded sequentially or simultaneously.

Figure 8:
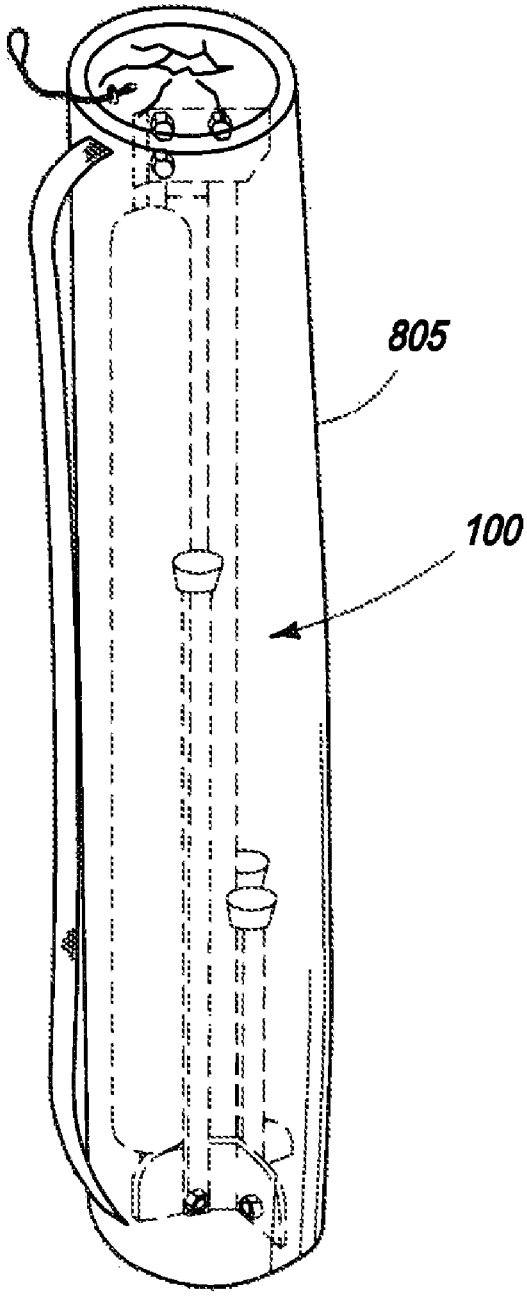
FIG. 8 illustrates the collapsed sign of FIG. 7 inserted into a carrying bag.

FIG. 8 illustrates the collapsed sign 100 of FIG. 7 inserted into a carrying bag 805. Although use of the carrying bag 805 is optional, some of the advantages associated with the sign 100 include transportability and compactness.

Figure 9:
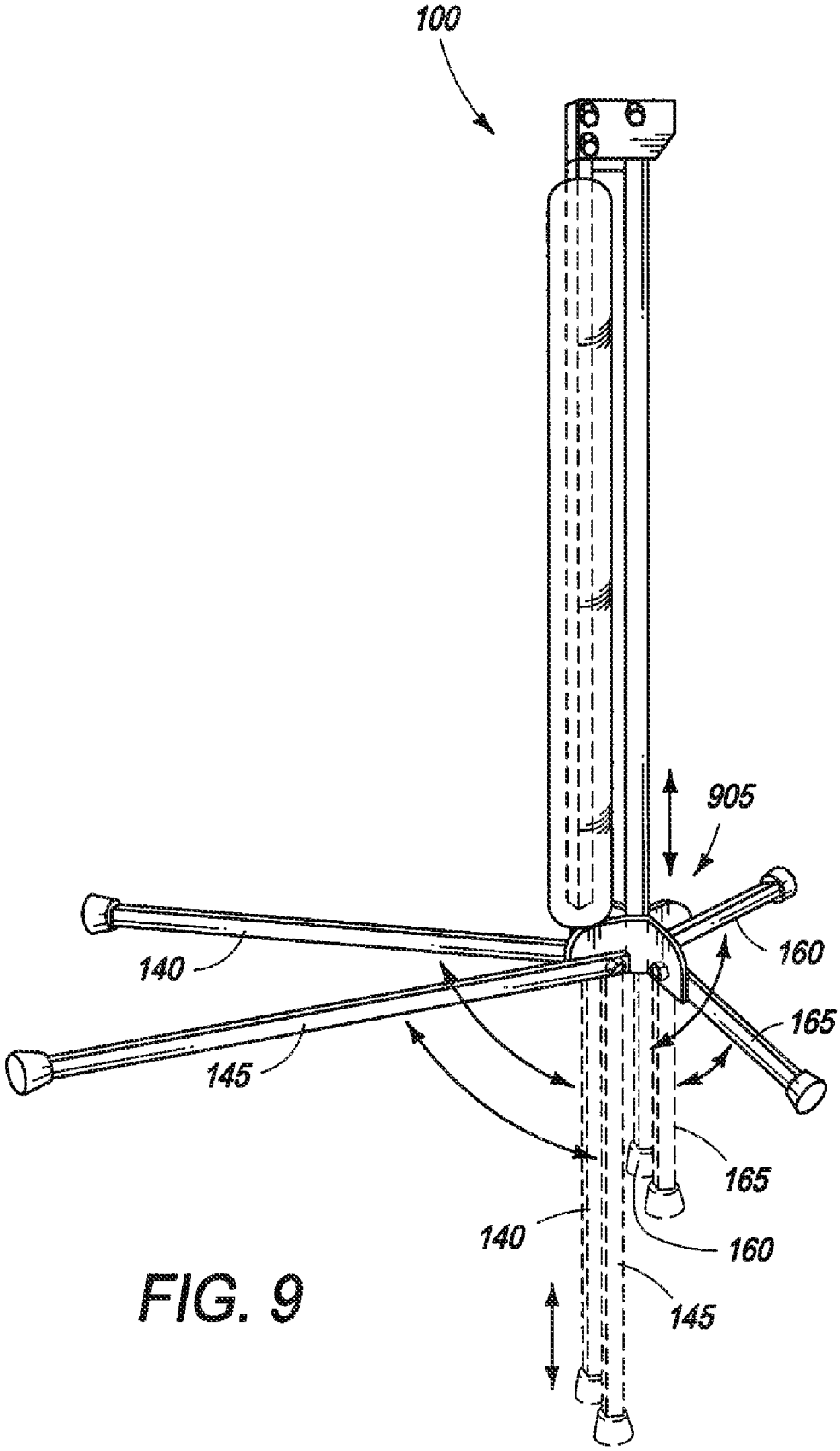
FIG. 9 illustrates the partially collapsed sign of FIG. 6, including legs folded to a substantially parallel arrangement with the upright member, according to still another example embodiment of the present invention.

FIG. 9 illustrates the partially collapsed sign 100 of FIG. 6, including legs 140, 145, 160, and 165 folded to a substantially parallel arrangement with the upright member 110, according to still another example embodiment of the present invention. Each of the legs 140, 145, 160, and 165 may be folded and unfolded either individually or at a same time. For example, one method for collapsing the sign 100 may include simultaneously folding legs 140, 145, 160, and 165 to a substantially parallel arrangement with the upright member 110. Similarly, one method for un-collapsing the sign 100 may include simultaneously unfolding legs 140, 145, 160, and 165 to locked locations extending in directions outward from the upright member 110. In addition, as shown in FIG. 9, hinge means 905 may slide along the upright member 110 either after or before the legs 140, 145, 160, and 165 are folded to the substantially parallel arrangement with the upright member 110.

Pertaining to folding the legs, a first leg 140 may be folded from a location extending in a first direction (e.g., direction 150 of FIG. 1) outward from the upright member 110 to a first location substantially parallel with and extending downward from the upright member 110 of the sign 100. A second leg 145 may be folded from a location extending in a second direction (e.g., direction 155 of FIG. 1) outward from the upright member 110 to a second location substantially parallel with and extending downward from the upright member 110 of the sign 100. A third leg 160 may be folded from a location extending in a third direction (e.g., direction 170 of FIG. 1) outward from the upright member 110 to a third location substantially parallel with and extending downward from the upright member 110 of the sign 100. And a fourth leg 165 may be folded from a location extending in a fourth direction (e.g., direction 175 of FIG. 1) outward from the upright member 110 to a fourth location substantially parallel with and extending downward from the upright member 110 of the sign 100. The legs may be folded sequentially or simultaneously. In addition, the locations from which the legs are folded may include locked locations, as further described below.

Pertaining to unfolding the legs, a first leg 140 may be unfolded from a first location substantially parallel with and downwardly extended from the upright member 110 of the sign 100 to a locked location extending in a first direction (e.g., direction 150 of FIG. 1) outward from the upright member 110. A second leg 145 may be unfolded from a second location substantially parallel with and downwardly extended from the upright member 110 of the sign 100 to a locked location extending in a second direction (e.g., direction 155 of FIG. 1) outward from the upright member 110. A third leg 160 may be unfolded from a third location substantially parallel with and downwardly extended from the upright member 110 of the sign 100 to a locked location extending in a third direction (e.g., direction 170 of FIG. 1) outward from the upright member 110. And a fourth leg 165 may be unfolded from a fourth location substantially parallel with and downwardly extended from the upright member 110 of the sign 100 to a locked location extending in a fourth direction (e.g., direction 175 of FIG. 1) outward from the upright member 110. Similar to the folding of the legs as described above, the legs may be unfolded sequentially or simultaneously.

Figure 10:
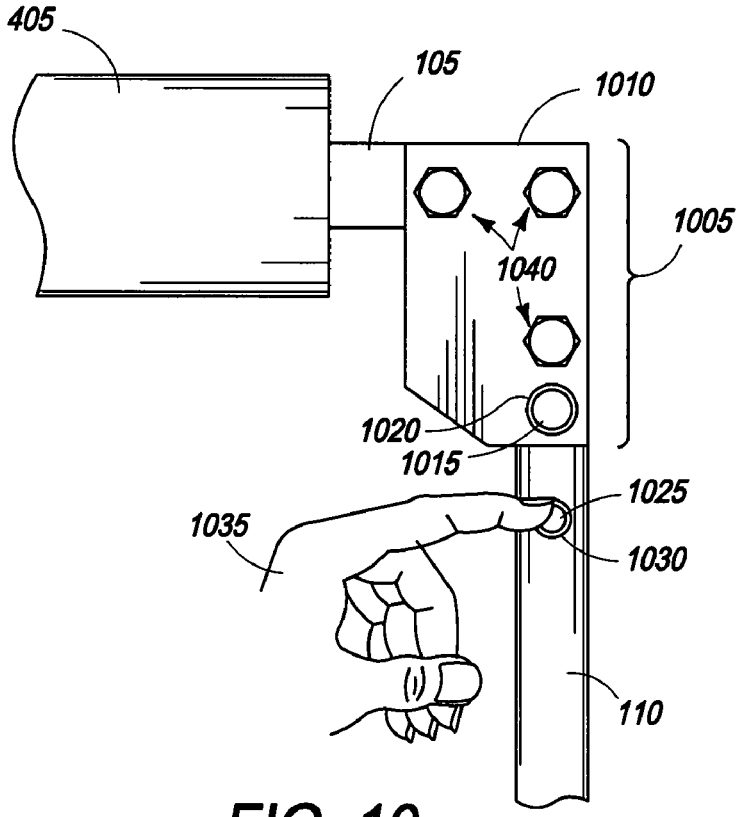
FIG. 10 illustrates an example embodiment of hinge means for attaching the pivotal sign carrying member to the upright member.
Figure 11:
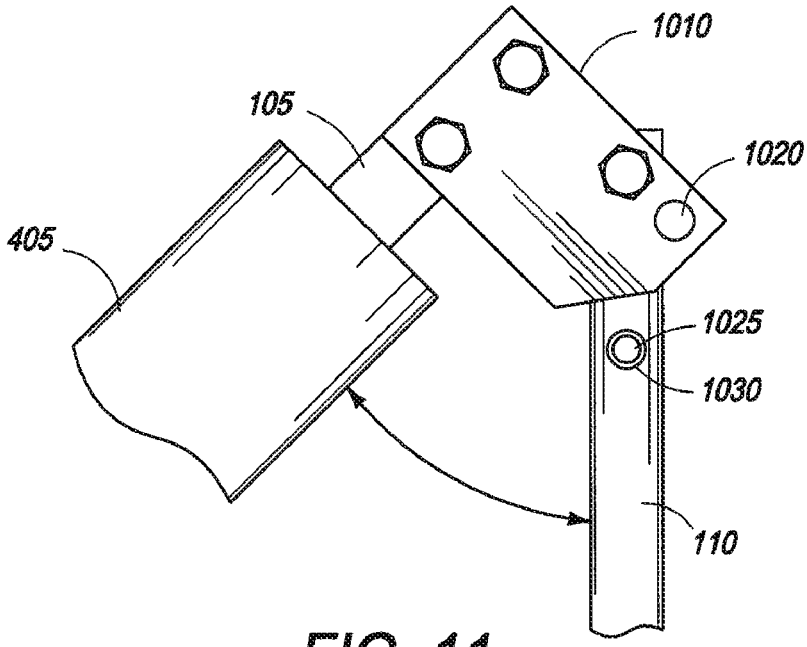
FIG. 11 illustrates another view of the hinge means of FIG. 10.

FIG. 10 illustrates an example embodiment of hinge means 1005 for attaching the pivotal sign carrying member 105 to the upright member 110. The hinge means 1005 may comprise different forms of locking mechanisms such as slider clips (not shown), a friction hinge (not shown), among other possibilities. The example embodiment shown in FIG. 10 includes the hinge means 1005 for attaching the pivotal sign carrying member 105 to the upright member 110. The hinge means 1005 of FIG. 10 may include a bracket 1010 and bolts 1040. The pivotal sign carrying member 105 and the upright member 110 may be interposed between the bracket 1010 and secured by the bolts 1040.

The hinge means 1005 may also include a locking member 1015 projecting through a first aperture 1020 of the upright member 110 and through an aperture 1020 of the bracket 1010. The locking member 1015 may be adapted to lock the pivotal sign carrying member 105 into a substantially perpendicular arrangement with the upright member 110. The hinge means 1005 may further include an actuator 1025 projecting through a second aperture 1030 of the upright member 110.

The actuator 1025 may be actuated by hand 1035 or by some other human intervention. The actuator 1025 may be communicatively coupled with the locking member 1015 and adapted to disengage the locking member 1015. The actuator 1025 and the locking member 1015 may be springably attached, as later described below.

FIG. 1 illustrates another view of the hinge means of FIG. 10. Here, the locking member 1015 of FIG. 10 has been disengaged, and the sign carrying member 105 is now free to move to the location substantially parallel to the upright member 110. The bracket 1010 rotates to allow the sign carrying member 105 to pivot toward the upright member 110. The locking member 1015 of FIG. 10 may remain disengaged until the pivotal sign carrying member 105 is returned to the location substantially perpendicular to the upright member 110, at which time the locking member 1015 of FIG. 10 may automatically reengage. In other words, the locking member 1015 of FIG. 10 may again project through aperture 1020 upon reengagement.

Figure 12:
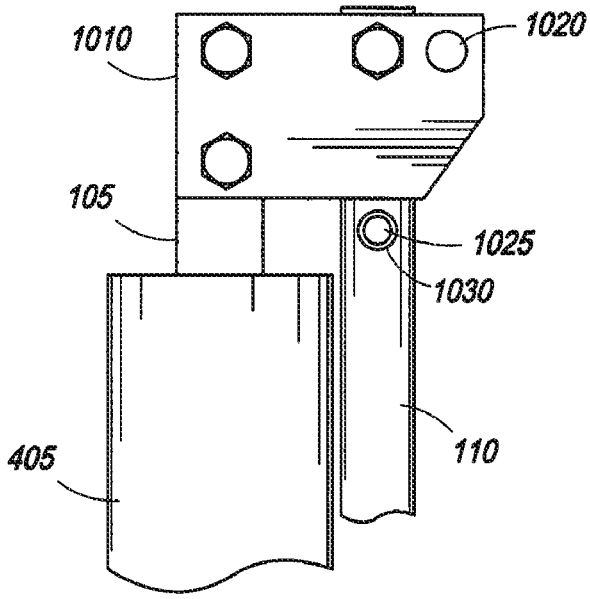
FIG. 12 illustrates yet another view of the hinge means of FIG. 10.

FIG. 12 illustrates yet another view of the hinge means of FIG. 10. Here, the sign carrying member 105 is shown in the substantially parallel arrangement with the upright member 110 with the locking member 1015 of FIG. 10 disengaged from the aperture 1020.

Figure 13:
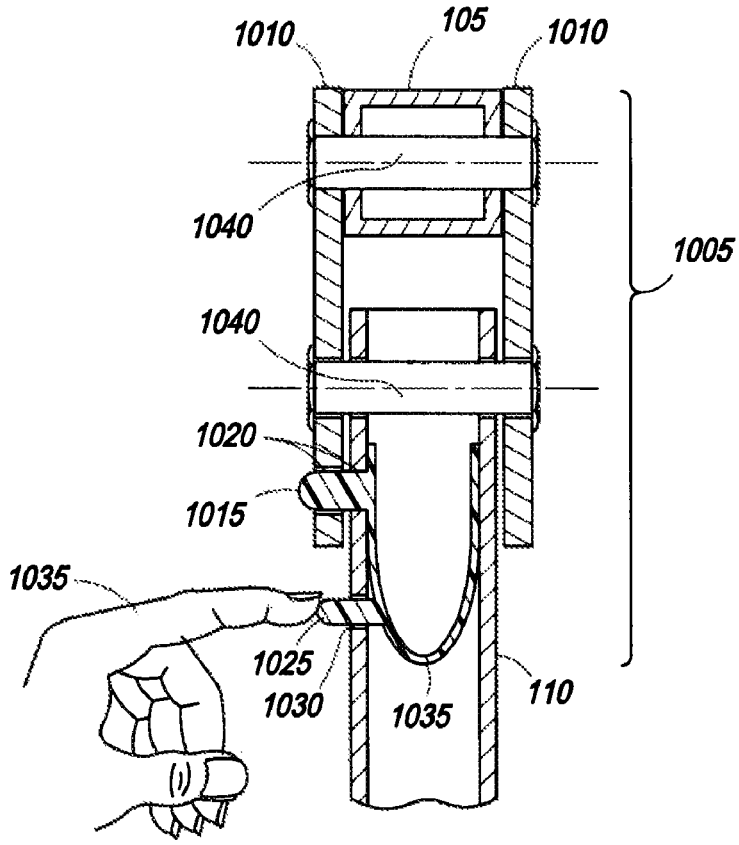
FIG. 13 illustrates a cross sectional view of the hinge means of FIG. 10, according to the example embodiment of the hinge means of the present invention.

FIG. 13 illustrates a cross sectional view of the hinge means of FIG. 10, according to the example embodiment of the hinge means 1005 of the present invention. The cross section view shows an inner portion of the upright member 110 where the locking member 1015 and the actuator 1025 may be communicatively coupled and springably attached to an inner wall of the upright member 110. The cross section view also shows portions of the bracket 1010 and bolts 1040 passing through the bracket 1010, the pivotal sign carrying member 105, and the upright member 110.

As previously explained, hand 1035 may press actuator 1025 thereby causing locking member 1015 to disengage. Once the locking member 1015 has disengaged, the bracket 1010 may rotate, thereby causing the sign carrying member 105 to pivot toward the upright member 110 until the sign carrying member 105 and the upright member 110 are in a substantially parallel arrangement.

Figure 14:
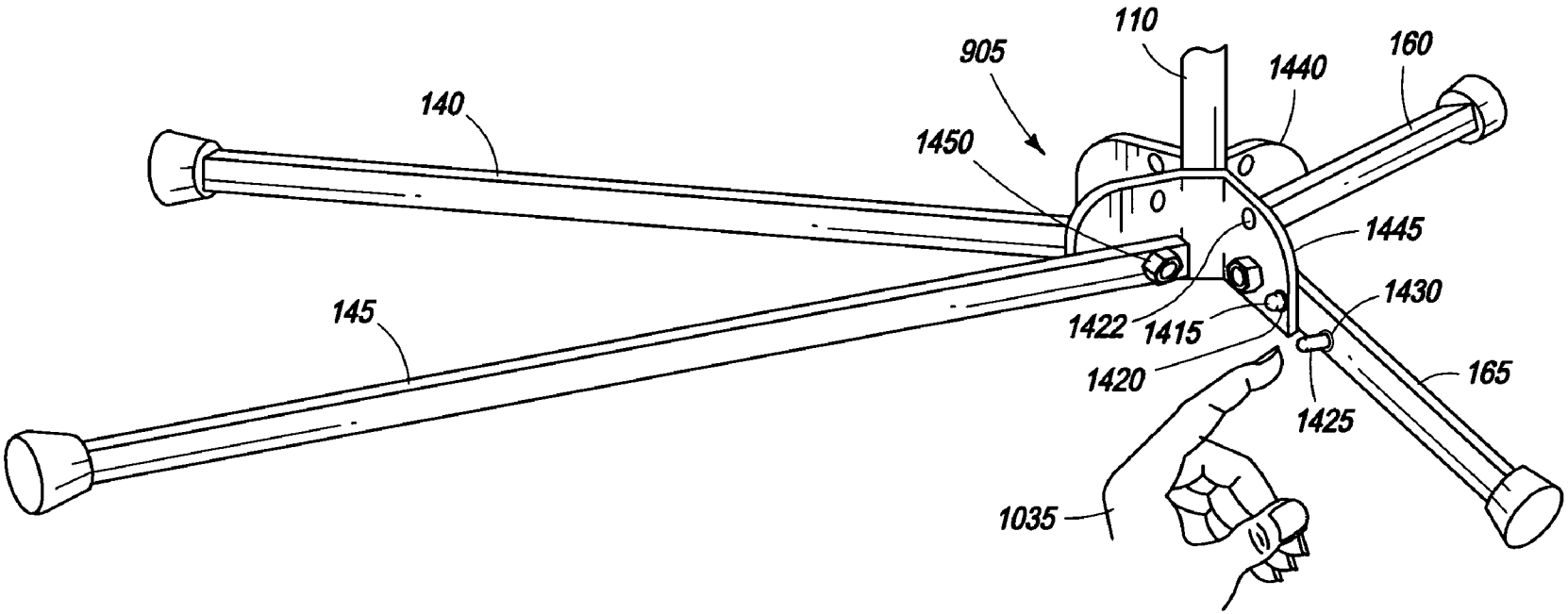
FIG. 14 illustrates an example embodiment of a support member comprising four foldable legs adapted to stabilize the upright member and the pivotal sign carrying member.

FIG. 14 illustrates an example embodiment of a support member (e.g. 115 of FIG. 1) comprising four foldable legs 140, 145, 160, and 165 adapted to stabilize the upright member 110 and the pivotal sign carrying member 105. The sign 100 may include second hinge means 905 for attaching the legs of the support member to the upright member 110. The second hinge means 905 may comprise a first bracket 1440 and a second bracket 1445. Each of the brackets 1440 and 1445 may be associated with two or more of the legs 140, 145, 160, and 165. Each bracket 1440 and 1445 may include a first aperture (e.g., 1420) and a second aperture (e.g., 1422) on each face of the bracket. For example, bracket 1440 may include the first aperture (e.g., 1420) and the second aperture (e.g., 1422) on a first face associated with one leg (e.g., 165), and two more similarly situated apertures on a second face associated with another leg (e.g., 145).

Moreover, each face of the brackets 1440 and 1445 may include a locking member associated with each leg. For example, a locking member 1415 may project through a first aperture 1420 of leg 165 and through an aperture 1420 of the bracket 1445. The locking member 1415 may be adapted to lock the leg 165 into a location extending in a direction outward from the upright member 110. Alternatively, the locking member 1415 may be adapted to lock the leg 165 into a location substantially parallel with the upright member 110 by engaging the locking member 1415 through aperture 1422 of the bracket 1445.

The second hinge means 905 may further include an actuator 1425 projecting through a second aperture 1430 of the leg 165. The actuator 1425 may be communicatively coupled with the locking member 1415 and adapted to disengage the locking member 1415. The method of engaging and disengaging the locking member 1415 using hand 1035 or some other human intervention may be similar to that described above with reference to FIG. 13. While the locking member 1415, the actuator 1425, and the associated apertures have been discussed with reference to one face of bracket 1445, a similar structure and method may apply to other legs 140, 145, and 160 and to other parts of bracket 1445 or 1440. Also, the legs 140, 145, 160, and 165 may be coupled to the bracket 1445 or 1440 using bolts 1450 or some other suitable coupling means.

Figure 15:
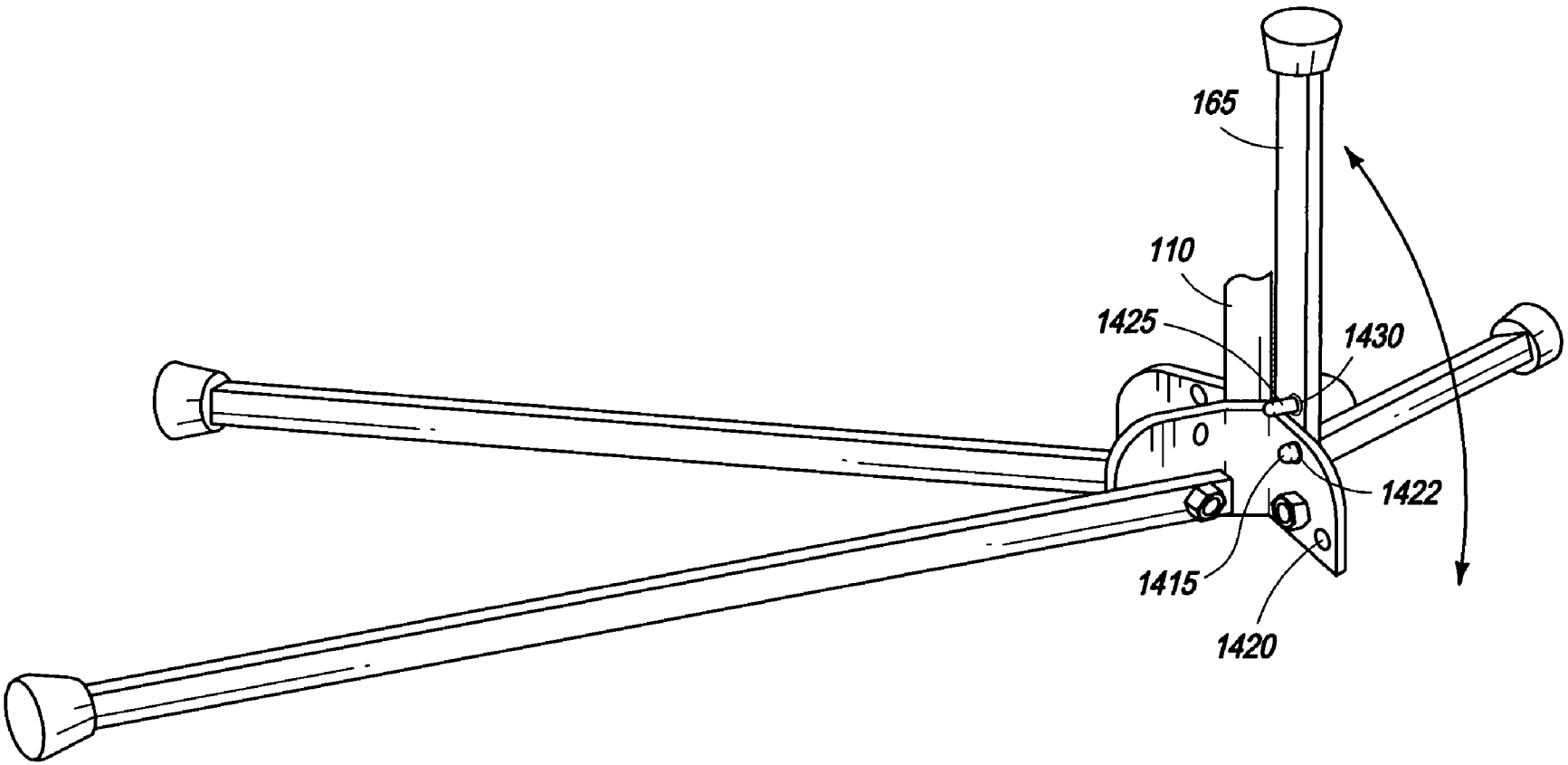
FIG. 15 illustrates the example embodiment of the support member including second hinge means for attaching the legs of the support member to the upright member.
Figure 16:
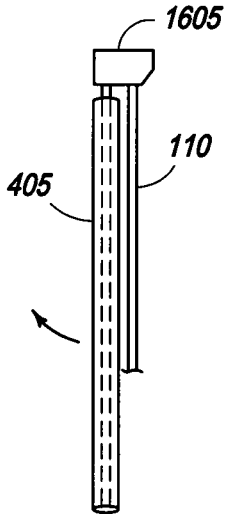
FIGS. 16-20 illustrate an upper portion of the collapsible sign of FIG. 1 in various stages of un-collapse, including pivoting the pivotal sign carrying member about 90 degrees respective to the upright member, and unrolling the flexible membrane from around the pivotal sign carrying member, according to another example embodiment of the present invention.
Figure 17:
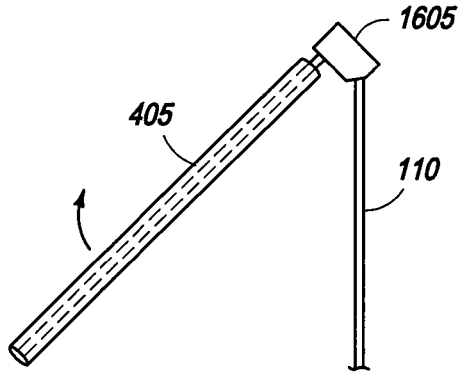
Figure 18:
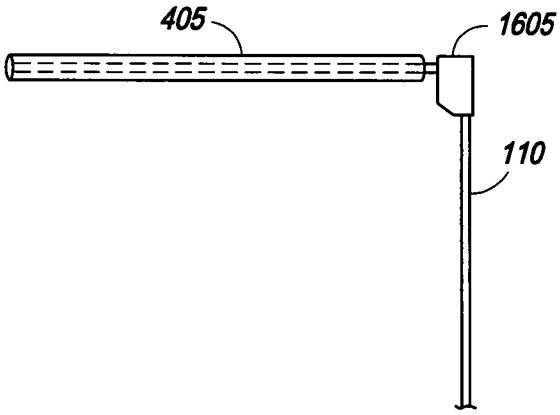
Figure 19:
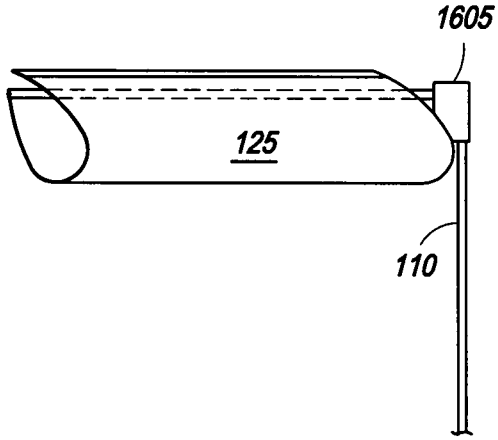
Figure 20:
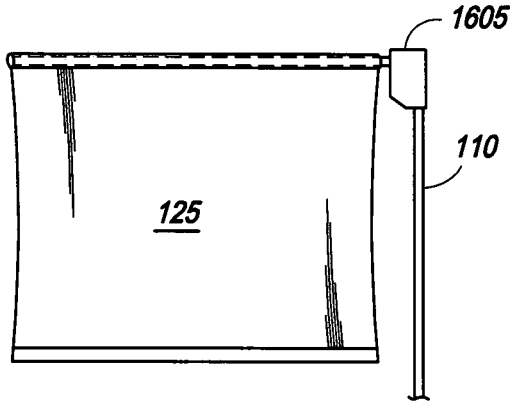
Figure 21:
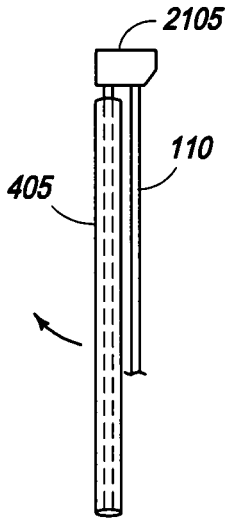
FIGS. 21-25 illustrate an upper portion of the collapsible sign of FIG. 1 in various stages of un-collapse, including pivoting the pivotal sign carrying member about 270 degrees respective to the upright member, and unrolling the flexible membrane from around the pivotal sign carrying member, according to yet another example embodiment of the present invention.
Figure 22:
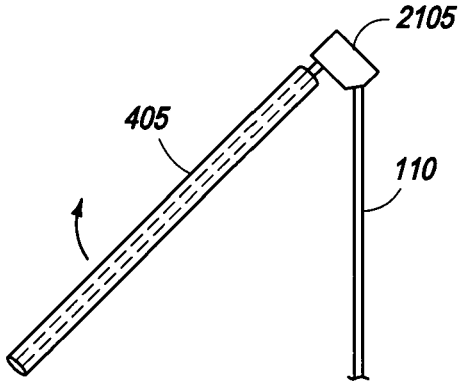
Figure 23:
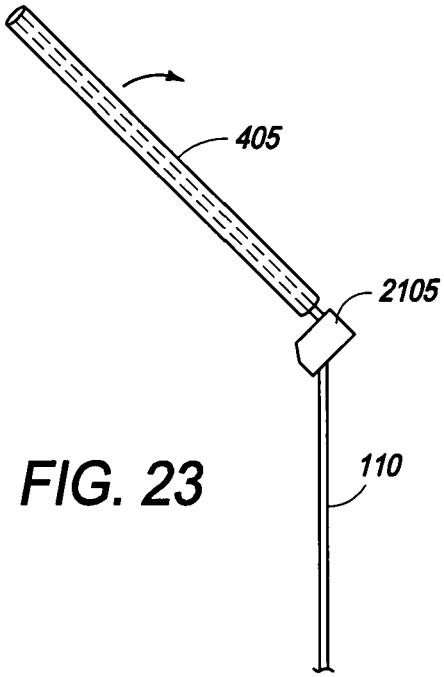
Figure 24:
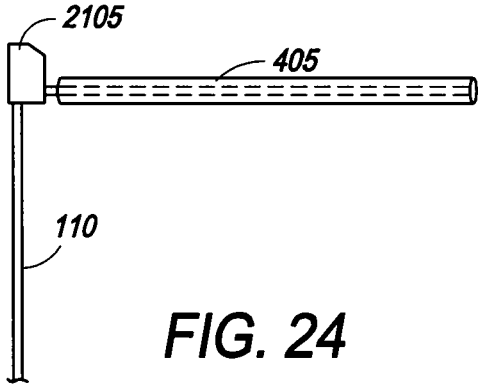
Figure 25:
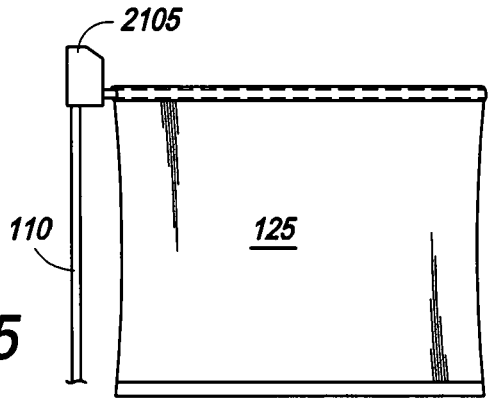

FIG. 15 illustrates the example embodiment of the support member (e.g., 115 of FIG. 1) including second hinge means (e.g., 905 of FIG. 14) for attaching the legs of the support member to the upright member 110. Specifically, FIG. 15 shows leg 165 in the location substantially parallel with the upright member 110 and the locking member 1415 projecting through aperture 1422, thereby engaging the locking member 1415. Meanwhile, aperture 1420 remains ready to engage the locking member 1415 when the leg 165 transitions back to the location extending away from the upright member 110.

FIGS. 16-20 illustrate an upper portion of the collapsible sign 100 of FIG. 1 in various stages of un-collapse, including pivoting the pivotal sign carrying member 105 about 90 degrees respective to the upright member 115, and unrolling the flexible membrane 125 from around the pivotal sign carrying member 105, according to another example embodiment of the present invention.

The upper portion of the collapsible sign 100 including the pivotal sign carrying member 105 may be un-collapsed. For example, the pivotal sign carrying member 105 may be unfolded from the location substantially parallel with the upright member 110 and locked in a substantially perpendicular arrangement with the upright member. The upper portion of the collapsible sign 100 may include hinge means 1605, which may include a hinging mechanism for attaching the pivotal sign carrying member 105 to the upright member 110, and allowing the sign carrying member 105 to pivot respective to the upright member 110.

Moreover, the upright member 110 may be springably coupled (not shown) to the pivotal sign carrying member 105 so that the sign carrying member 105 may flex or twist slightly respective to the upright member 110. This provides additional overall stability to the sign 100, and the ability to deflect impacts, particularly in the presence of a wind gust or some other type of interference such as a person or vehicle bumping the sign 100. The spring coupling may include the use of a coil spring (not shown), among other possibilities. In addition, the pivotal sign carrying member 105, the upright member 110, or other parts of sign 100, may be comprised of a flexible material such as fiberglass, which provides a degree or some degrees of flexing or slight twisting of the pivotal sign carrying member 105, thereby enhancing the overall stability of the sign 100.

As shown in FIGS. 16-20, the pivotal sign carrying member 105 may be pivoted or traversed about 90 degrees respective to the upright member 110. Once the pivotal sign carrying member 105 is locked in the substantially perpendicular arrangement with the upright member 110, the flexible membrane 125 may be unrolled from around the pivotal sign carrying member 105 so that the flexible membrane 125 hangs from the pivotal sign carrying member 105. A weighted bottom (e.g., 130 of FIG. 1) may facilitate the unrolling of the flexible membrane 125 from the pivotal sign carrying member 105.

FIGS. 21-25 illustrate an upper portion of the collapsible sign 100 of FIG. 1 in various stages of un-collapse, including pivoting the pivotal sign carrying member 105 about 270 degrees respective to the upright member 110, and unrolling the flexible membrane 125 from around the pivotal sign carrying member 105, according to yet another example embodiment of the present invention. The example embodiment of FIGS. 21-25 is similar to that of FIGS. 16-20 except that the pivotal sign carrying member 105 may be pivoted or traversed about 270 degrees respective to the upright member 110. Since the remaining description of this embodiment is similar to that of FIGS. 16-20, it will be omitted here for the sake of brevity.

Figure 26:
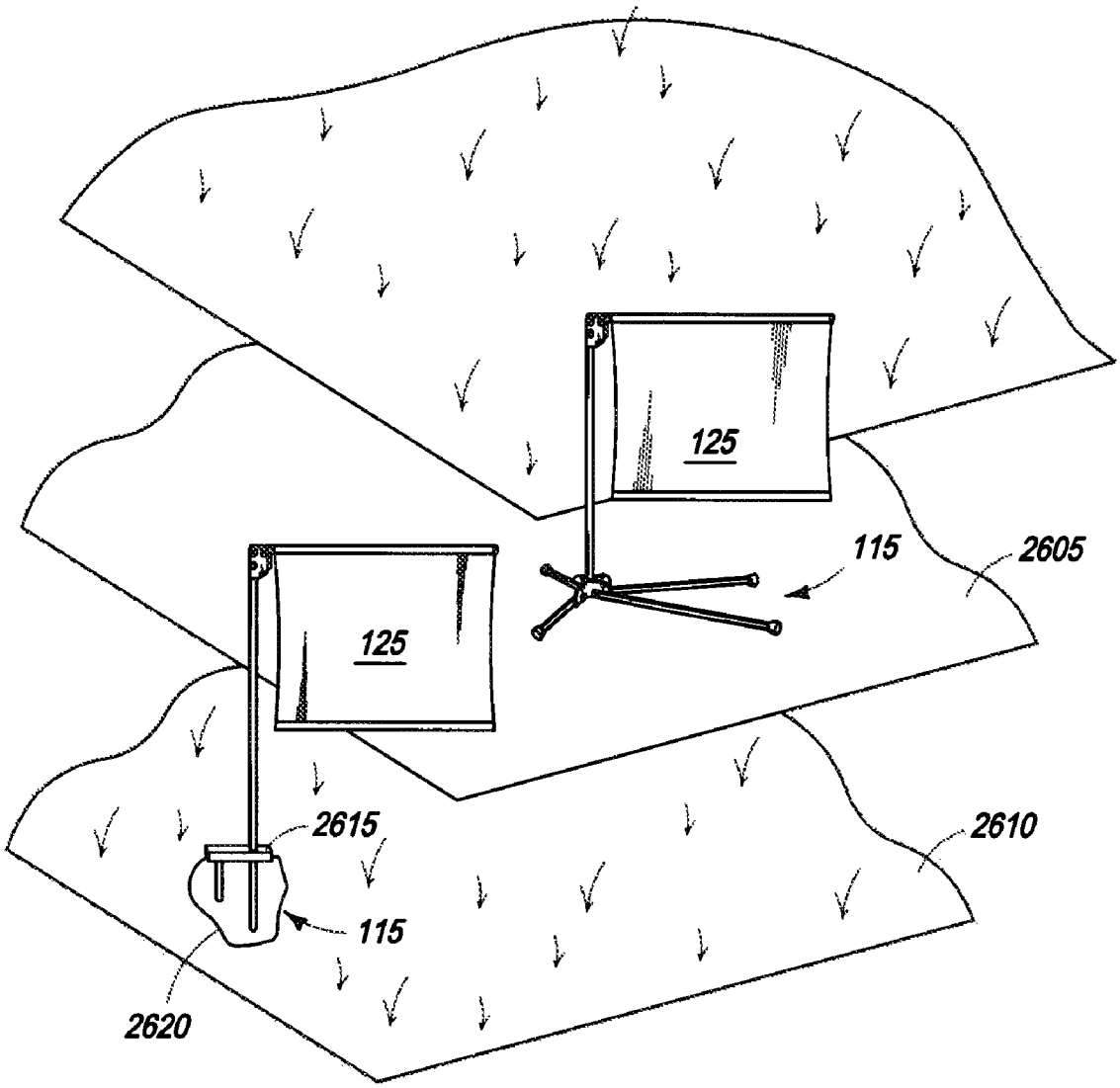
FIG. 26 illustrates a first example embodiment of a collapsible sign located on a sidewalk and a second example embodiment of a collapsible sign located on a grassy or earthy location.

FIG. 26 illustrates a first example embodiment of a collapsible sign capable of being located on a sidewalk 2605 and a second example embodiment of a collapsible sign located on a grassy or earthy location 2610. The support member 115 of the first example embodiment of the collapsible sign located on the sidewalk 2605 generally corresponds to support member described above. The support member 115 having the asymmetric arrangement of legs, as located on the sidewalk or other surface, may also have a weighted object such as a sand bag (not shown) placed thereon. In other words, the sand bag (or other weighted object) may be placed on one or more of the legs of the sign to provide further stability to the sign.

The second example embodiment includes a collapsible sign capable of being located on the grassy or earthy location 2610. The support member 115 of the second example embodiment of the collapsible sign located on the grassy or earthy location 2610 may comprise a base member 2615 in a perpendicular arrangement with the upright member 110, the base member 2615 located at a lower portion of the upright member 110, as also described in more detail below, and may also comprise penetration means 2620 for penetrating the grassy or earthy location 2610.

FIGS. 27-31 illustrate various example embodiments of the penetration means 2620 of FIG. 26, including means for stabilizing the upright member 110 and the sign carrying member 105. Each of FIGS. 27-31 will now be described in further detail.

Figure 27:
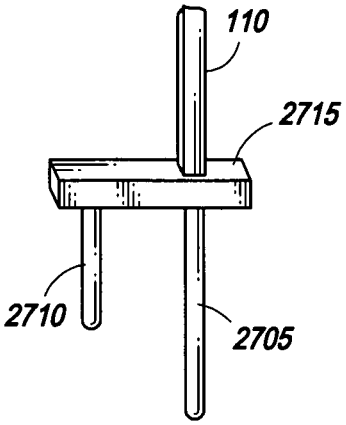
FIGS. 27-31 illustrate various example embodiments of penetration means including means for stabilizing the upright member and the sign carrying member.

FIG. 27 illustrates a base member 2715 in a perpendicular arrangement with the upright member 110. The upright member 110 may be coupled to the base member 2715 at a location between a middle part of the base member 2715 and an end part of the base member 2715. The penetration means may include a double stake configuration comprising a first stake 2710 having a first length and a second stake 2705 having a second length greater than the first length. The second stake 2705 having the second length that is greater may be located directly under the upright member 110, and the first stake 2710 having the first length may be located spaced apart from the upright member 110, which is the preferable configuration when the sign carrying member 105 is pivoted by 90 degrees as shown in FIGS. 16-20 above.

The penetration means may also include stabilization means (e.g., 2710) for stabilizing the upright member 110 and the sign carrying member 105. The penetration means (e.g., 2710 and 2705) may penetrate the grassy or earthy location (e.g., 2610 of FIG. 26), and the stabilization means (e.g., 2710) may prevent the collapsible sign 100 from tipping over or spinning around. By keeping the sign 100 stationary, any information included on the flexible membrane 125 of the sign 100 can be more easily conveyed to persons desiring to see or read the information.

Figure 28:
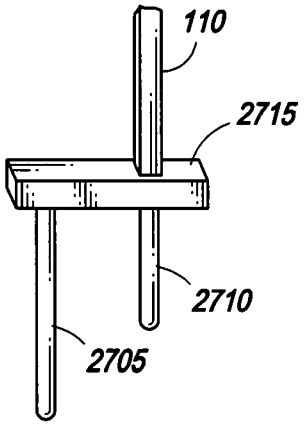

FIG. 28 illustrates an example embodiment that is similar to FIG. 27, except that the first stake 2710 having the first (shorter) length than the second stake 2705 may be located directly under the upright member 110, and the second stake 2705 may be located spaced apart from the upright member 110, which is the preferable configuration when the sign carrying member 105 is pivoted by 270 degrees as shown in FIGS. 21-25 above. The remaining details of the embodiment shown in FIG. 28 are similar to those shown in FIG. 27, and therefore will be omitted here for the sake of brevity.

Figure 29:
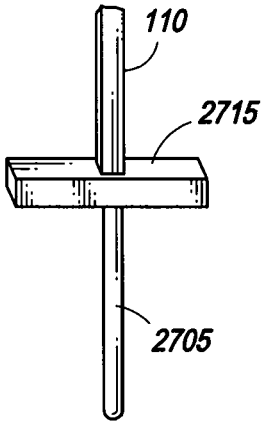

FIG. 29 illustrates a base member 2715 in a perpendicular arrangement with the upright member 110. The upright member 110 may be coupled to the base member 2715 at a location near or at a middle part of the base member 2715. The penetration means may include a single stake configuration comprising a single stake 2905 having a single length. The single stake 2905 may be located directly under the upright member 110. The penetration means (e.g., 2905) may penetrate the grassy or earthy location (e.g., 2610 of FIG. 26).

Figure 30:
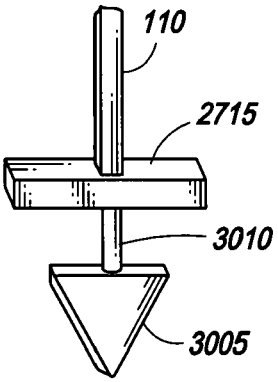

FIG. 30 illustrates a base member 2715 in a perpendicular arrangement with the upright member 110. The upright member 110 may be coupled to the base member 2715 at a location near or at a middle part of the base member 2715. The penetration means may include a tapered stake configuration comprising a partial stake 3010 coupled to a tapered stake 3005. The tapered stake 3005 may be triangular in shape. The partial stake 3010 may be located directly under the upright member 110.

The penetration means may also include stabilization means (e.g., 3005) for stabilizing the upright member 110 and the sign carrying member 105. The penetration means (e.g., 3010 and 3005) may penetrate the grassy or earthy location (e.g., 2610 of FIG. 26), and the stabilization means (e.g., 3005) may prevent the collapsible sign 100 from tipping over or spinning around. Also, tapered stake 3005, or even a smaller version of the tapered stake 3005, may be coupled to one or more of stakes 2710 and 2705 of the double stake configuration as shown in FIGS. 27 and 28 above, to form a double tapered stake configuration (not shown).

Figure 31:
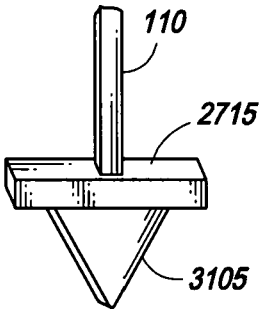

FIG. 31 illustrates a base member 2715 in a perpendicular arrangement with the upright member 110. The upright member 110 may be coupled to the base member 2715 at a location near or at a middle part of the base member 2715. The penetration means may include a tapered stake configuration comprising a tapered stake 3105. The tapered stake 3105 may be triangular in shape. The tapered stake 3105 may be located under the upright member 110.

The penetration means may also include stabilization means (e.g., 3105) for stabilizing the upright member 110 and the sign carrying member 105. The penetration means (e.g., 3105) may penetrate the grassy or earthy location (e.g., 2610 of FIG. 26), and the stabilization means (e.g., 3105) may prevent the collapsible sign 100 from tipping over or spinning around.

Moreover, the upright member 110 shown in FIGS. 1-31 may further comprise an upper portion 110 and a lower portion 110. The upper portion 110 of the upright member 110 may be springably coupled (not shown) to the lower portion 110 of the upright member 110. The lower portion 110 of the upright member 110 may be coupled to either the foldable support member 115 of the first example embodiment of the collapsible sign located on the sidewalk 2605 (of FIG. 26) or the support member 115 of the second example embodiment of the collapsible sign located on the grassy or earthy location

2610 (of FIG. 26). This provides additional overall stability to the sign 100, and the ability to deflect impacts, particularly in the presence of a wind gust or some other type of interference such as a person or vehicle bumping the sign 100. The spring coupling may include the use of a coil spring (not shown), among other possibilities.

Figure 32:
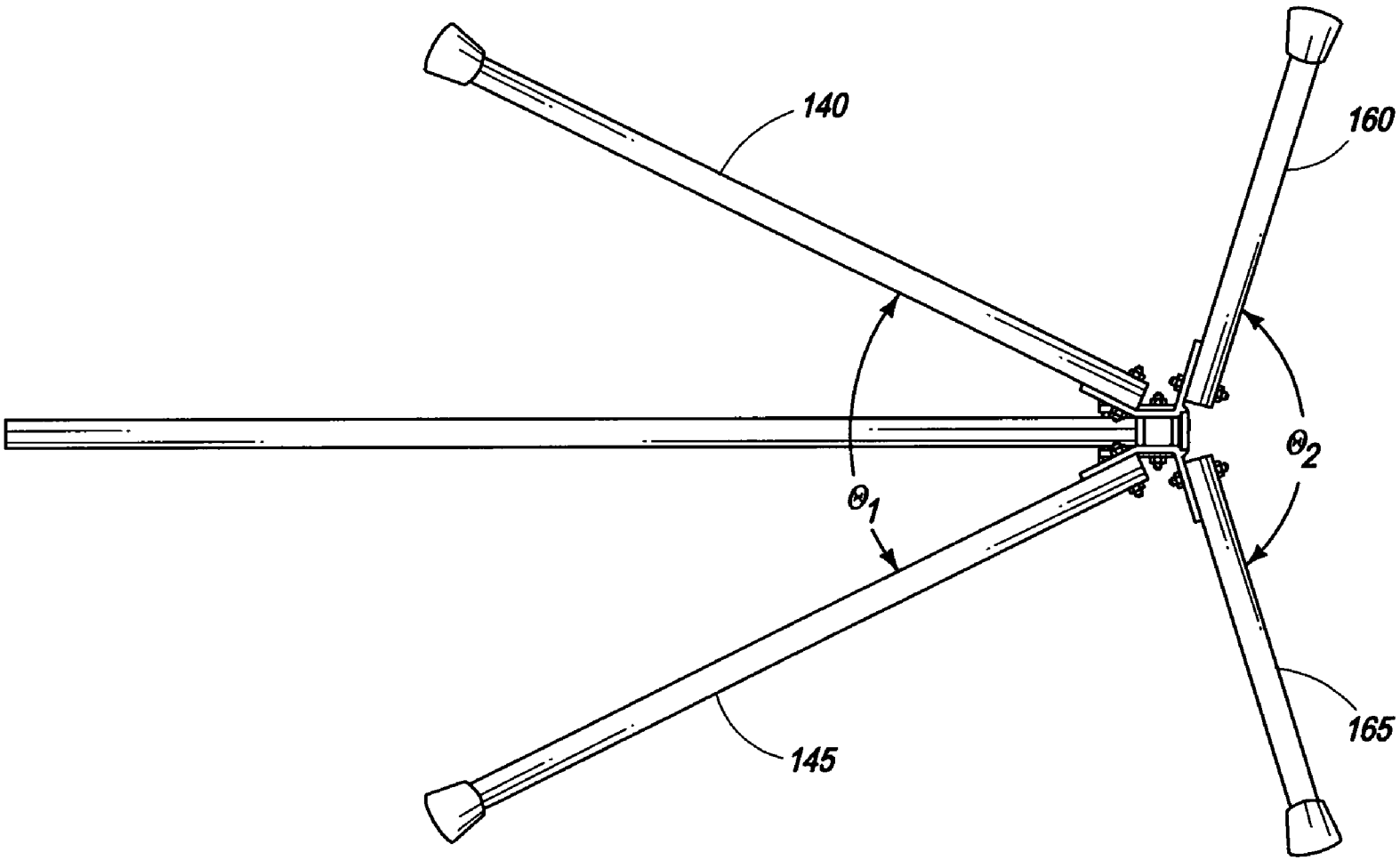
FIG. 32 illustrates a bottom view of the foldable support member of FIG. 1 including an asymmetric arrangement of legs, according to an example embodiment of the present invention.

FIG. 32 illustrates a bottom view of the foldable support member 115 of FIG. 1 including an asymmetric arrangement of legs 140, 145, 160, and 165, according to an example embodiment of the present invention. The asymmetric arrangement of legs may include first and second legs 140 and 145 extending by a first length in first and second directions, respectively. An angle $\theta_1$ between the first and second legs 140 and 145 may correspond to an acute angle, and a vertex of the acute angle $\theta_1$ may be located at approximately a base section of the upright member 110.

Similarly, the asymmetric arrangement of legs may include third and fourth legs 160 and 165 extending by a second length in third and fourth directions, respectively. An angle $\theta_2$ between the third and fourth legs 160 and 165 may correspond to an obtuse angle, and a vertex of the acute angle $\theta_2$ may be located at approximately a base section of the upright member 110.

In this manner, the asymmetric arrangement of legs stabilizes the collapsible sign 100 and also reduces a footprint of the sign, thereby providing a space-saving feature. The structure and arrangement of the asymmetric arrangement of legs, or alternatively the penetration and stabilization means, keeps the collapsible sign 100 stationary, and prevent the collapsible sign 100 from tipping over or spinning. Furthermore, gravity pulls the flexible membrane 125 downward, particularly when the weighted bottom 130 is coupled thereto, so that any writing or drawings are readily visible, even in the presence of weather elements such as wind. Moreover, the intuitive collapsible features of the sign 100 allow for rapid assembly, disassembly, and storage.

Having described and illustrated the principles of the invention with reference to illustrated embodiments, it will be recognized that the illustrated embodiments can be modified in arrangement and detail without departing from such principles, and can be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms can reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

What is claimed is:

1. A collapsible sign, comprising:

a pivotal sign carrying member;

an upright member hingedly attached to the pivotal sign carrying member; and a foldable support member adapted to stabilize the upright member and the pivotal sign carrying member;

wherein:

the foldable support member includes an asymmetric arrangement of legs hingedly attached to the upright member;

the asymmetric arrangement of legs includes first and second legs extending by a first length in first and second directions, respectively;

an angle between the first and second legs corresponds to an acute angle;

a vertex of the acute angle is located at approximately a base section of the upright member;

the asymmetric arrangement of legs includes first and second legs extending by a first length in first and second directions, respectively;

an angle between the first and second legs corresponds to an acute angle;

a vertex of the acute angle is located at approximately a base section of the upright member;

the asymmetric arrangement of legs includes third and fourth legs extending by a second length in third and fourth directions, respectively;

an angle between the third and fourth legs corresponds to an obtuse angle;

a vertex of the obtuse angle is located at approximately the base section of the upright member; and the second length is less than the first length.

2. The collapsible sign of claim 1, wherein the pivotal sign carrying member is adapted to lock into a substantially perpendicular arrangement with the upright member.

3. The collapsible sign of claim 1, wherein the pivotal sign carrying member is adapted to fold into a substantially parallel arrangement with the upright member.

4. The collapsible sign of claim 3, further comprising a spacing between the pivotal sign carrying member and the upright member to accommodate a sign roll when the sign carrying member is folded.

5. The collapsible sign of claim 1, further comprising:

a first sleeve adapted to fit over the pivotal sign carrying member;

a flexible membrane, wherein one end of the flexible membrane is coupled to the first sleeve;

a weighted bottom; and a second sleeve adapted to fit over the weighted bottom, wherein another end of the flexible membrane is coupled to the second sleeve.

6. The collapsible sign of claim 5, wherein the first sleeve is adapted to attach to the pivotal sign carrying member, and wherein the flexible membrane is adapted to roll around the pivotal sign carrying member to form a substantially cylindrical sign roll.

7. The collapsible sign of claim 1, wherein each of the first, second, third, and fourth legs are adapted to fold to a substantially parallel arrangement with the upright member.

8. The collapsible sign of claim 1, wherein the upright member is springably coupled to the pivotal sign carrying member.

9. The collapsible sign of claim 1, wherein the upright member further comprises an upper portion and a lower portion, wherein the upper portion of the upright member is springably coupled to the lower portion of the upright member, and wherein the lower portion of the upright member is coupled to the foldable support member.

10. The collapsible sign of claim 1, wherein at least one of (a) the pivotal sign carrying member, (b) the upright member, and (c) the foldable support member, comprises a flexible material.

11. A collapsible sign, comprising:

a pivotal sign carrying member;

an upright member;

hinge means for attaching the pivotal sign carrying member to the upright member, wherein the hinge means comprises:

a locking member, wherein the locking member is adapted to lock the pivotal sign carrying member into a substantially perpendicular arrangement with the upright member; and an actuator, wherein the actuator is communicatively coupled with the locking member and adapted to disengage the locking member;

wherein:

the hinge means further comprises a bracket, wherein the pivotal sign carrying member and the upright member are interposed between the bracket;

the locking member projects through a first aperture of the upright member and through an aperture of the bracket;

the actuator projects through a second aperture of the upright member; and the locking member and the actuator are springably attached to an inner wall of the upright member.

12. The collapsible sign of claim 11, further comprising:

a support member comprising at least four foldable legs and adapted to stabilize the upright member and the pivotal sign carrying member; and second hinge means for attaching the at least four legs of the support member to the upright member, wherein the second hinge means comprises;

at least one bracket associated with at least one of the four legs of the support member;

at least two apertures in the at least one bracket for engaging the at least one of the four legs of the support member;

at least one locking member associated with the at least one bracket and the at least one of the four legs, the at least one locking member projecting through a first aperture of the at least one of the four legs and through one of the at least two apertures of the at least one bracket, wherein the at least one locking member is adapted to lock the at least one of the four legs into one of (a) a location substantially parallel with the upright member and (b) a location extending in a direction outward from the upright member; and at least one actuator projecting through a second aperture of the at least one of the four legs, wherein the at least one actuator is communicatively coupled with the at least one locking member and adapted to disengage the at least one locking member.

13. The collapsible sign of claim 11, further comprising:

a support member comprising a base member in a perpendicular arrangement with the upright member and located at a lower portion of the upright member; and penetration means for penetrating the ground.

14. The collapsible sign of claim 13, wherein the penetration means comprises means for stabilizing the upright member and the sign carrying member, and including at least one of: (a) a double stake configuration comprising a first stake having a first length and a second stake having a second length greater than the first length, (b) a single stake configuration, and (c) a tapered stake configuration.

15. A collapsible sign, comprising:

a pivotal sign carrying member;

an upright member;

hinge means for attaching the pivotal sign carrying member to the upright member, wherein the hinge means comprises:

a locking member, wherein the locking member is adapted to lock the pivotal sign carrying member into a substantially perpendicular arrangement with the upright member; and an actuator, wherein the actuator is communicatively coupled with the locking member and adapted to disengage the locking member;

a support member comprising at least four foldable legs and adapted to stabilize the upright member and the pivotal sign carrying member; and second hinge means for attaching the at least four legs of the support member to the upright member, wherein the second hinge means comprises:

at least one bracket associated with at least one of the four legs of the support member;

at least two apertures in the at least one bracket for engaging the at least one of the four legs of the support member;

at least one locking member associated with the at least one bracket and the at least one of the four legs, the at least one locking member projecting through a first aperture of the at least one of the four legs and through one of the at least two apertures of the at least one bracket, wherein the at least one locking member is adapted to lock the at least one of the four legs into one of (a) a location substantially parallel with the upright member and (b) a location extending in a direction outward from the upright member; and at least one actuator projecting through a second aperture of the at least one of the four legs, wherein the at least one actuator is communicatively coupled with the at least one locking member and adapted to disengage the at least one locking member.

* * * * *